US005778452A

United States Patent [19]

Dicker et al.

[11] Patent Number: 5,778,452

[45] Date of Patent: Jul. 14, 1998

[54] EXERCISE GARMENT

[76] Inventors: Timothy P. Dicker, 6906 Foothill Blvd., Tujunga, Calif. 91042-2780; William T. Wilkinson, P.O. Box 73, Salem, N.J. 08079

[21] Appl. No.: 840,917

[22] Filed: Apr. 25, 1997

[51] Int. Cl.[6] ..... A41B 1/12

[52] U.S. Cl. ..... 2/69; 2/227; 2/79

[58] Field of Search ..... 2/69, 79, 227, 2/228, 238, 102, 108, 115; 482/74, 14, 105, 121, 124, 131

[56] References Cited

U.S. PATENT DOCUMENTS

| | | |
|---|---|---|
| 1,178,165 | 8/1916 | Lupton . |
| 2,097,376 | 10/1937 | Marshman . |
| 2,613,932 | 10/1952 | Manners . |
| 3,411,500 | 11/1968 | Gatts . |
| 3,559,654 | 2/1971 | Pope . |
| 3,759,510 | 9/1973 | Jackson . |
| 4,065,814 | 1/1978 | Fox . |
| 4,220,299 | 9/1980 | Motter . |
| 4,325,379 | 4/1982 | Ozbey . |
| 4,384,369 | 5/1983 | Prince . |
| 4,670,913 | 6/1987 | Morell . |
| 4,698,847 | 10/1987 | Yoshihara . |
| 4,910,802 | 3/1990 | Malloy . |
| 4,953,856 | 9/1990 | Fox . |
| 4,961,573 | 10/1990 | Wehrell . |
| 4,968,028 | 11/1990 | Wehrell . |
| 4,993,705 | 2/1991 | Tolle . |
| 5,033,123 | 7/1991 | Audet . |
| 5,046,194 | 9/1991 | Alaniz . |
| 5,060,315 | 10/1991 | Ewing . |
| 5,062,642 | 11/1991 | Berry . |
| 5,109,546 | 5/1992 | Dicker . |
| 5,141,223 | 8/1992 | Block . |
| 5,176,600 | 1/1993 | Wilkinson . |
| 5,186,701 | 2/1993 | Wilkinson . |
| 5,201,074 | 4/1993 | Dicker . |
| 5,203,754 | 4/1993 | Maclean . |
| 5,256,119 | 10/1993 | Tudor . |
| 5,263,916 | 11/1993 | Bobich . |
| 5,267,928 | 12/1993 | Barile . |
| 5,282,277 | 2/1994 | Onozawa . |
| 5,306,222 | 4/1994 | Wilkinson . |
| 5,308,305 | 5/1994 | Romney . |
| 5,336,139 | 8/1994 | Miller . |
| 5,357,637 | 10/1994 | Moore . |
| 5,367,708 | 11/1994 | Fujimoto . |
| 5,372,565 | 12/1994 | Burdenko . |
| 5,375,610 | 12/1994 | Lacourse . |
| 5,383,235 | 1/1995 | Peters . |
| 5,465,428 | 11/1995 | Earl . |
| 5,518,480 | 5/1996 | Frappier . |
| 5,518,481 | 5/1996 | Darkwah . |
| 5,570,472 | 11/1996 | Dicker . |

*Primary Examiner*—Gloria M. Hale
*Attorney, Agent, or Firm*—Connolly & Hutz

[57] ABSTRACT

An exercise garment includes an outer layer of clothing which is in the form of a warm up suit or sweatsuit loosely fitting on the user. An inner layer of clothing made of elastic resistance material is secured to the inside of the outer layer of clothing. The inner layer of clothing is anchored at spaced locations so that the user is required to stretch the material of the inner layer during various body movements while the outer layer remains loose fitting.

17 Claims, 2 Drawing Sheets

EXERCISE GARMENT

BACKGROUND OF THE INVENTION

The present invention relates to exercise garments. Such garments have been disclosed which incorporate elongated elastic resilient elements or which include garments having portions made of elastic resistance material. In the use of such garments when the user performs certain activities, such as bending motions of the hands, legs or body, energy is expended in stretching the resistance material and then in resisting the material to returning to its original condition. It has also been suggested that garments of this general type may be worn over prolonged periods of time as a means of aiding in weight loss in the sense that the energy expended during an activity by someone wearing the garment would be more than if the same person were involved in the same activity without wearing the garment.

It would be desirable if the benefits of such exercise garments could be achieved in a manner wherein it is not readily apparent to others that such type of garment is being worn.

SUMMARY OF THE INVENTION

An object of this invention is to provide an exercise garment which incorporates the resistance elements or material in such a manner that it is not readily apparent that such type of garment is being used.

A further object of this invention is to provide such an exercise garment which could be worn over prolonged periods of time to enhance weight loss.

In accordance with this invention the exercise garment's structural features are located inside a loose fitting sweatsuit or warmup garment so as to generally conceal the resistance elements.

Various types of garment structures are possible in accordance with this invention. The resistance elements or material may be physically joined to the inner surface of the sweatsuit or may be incorporated in a separate garment secured to and worn beneath the sweatsuit. Preferably remote portions of the resistance elements are anchored to the sweatsuit such as at the waist, ankles (feet), wrists (hands) or shoulders.

THE DRAWINGS

DETAILED DESCRIPTION

Figure 1:
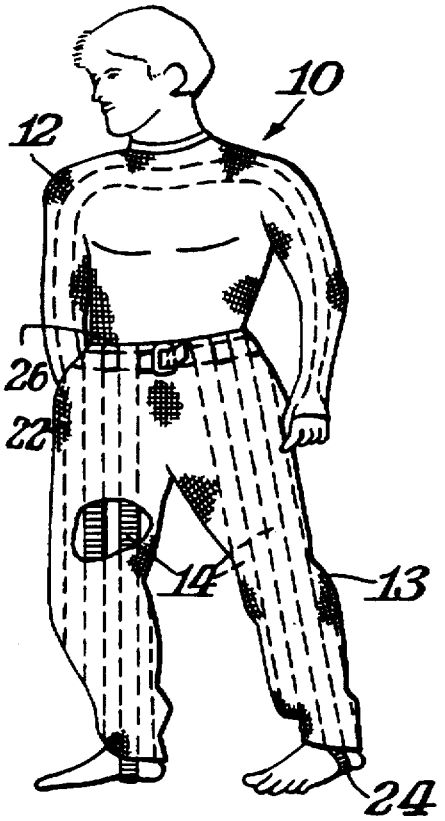
FIG. 1 is a front elevational view of an exercise garment in accordance with one embodiment of this invention.

The present invention relates in general to a loose or baggy type fitting garment such as a sweatsuit or warmup garment in contrast to a skin tight or closer fitting body suit. Such a loose fitting garment would lend itself to be cooler and to be used for more casual wear.

The garment may be composed of one or more pieces. For example, the garment could be a loose fitting one piece jumpsuit. Preferably, however, the garment is made in two pieces, namely a top and a pants. Each piece has a basic two piece structure composed of the base material which could be conventional material, such as is used in known sweatsuits or warmup garments and elastic resistance materials which could be in the form of elastic resistance bands. The suit could also have mesh panels to make it cooler and more breathable.

The elastic resistance could be achieved in various manners such as by the use of variable density weave or from separate elastic bands which could be mounted at any suitable locations as later described. The preferred resistance is elastic fabric in the form of bands that are sewn inside the top and/or pants. This allows for styling on the outside of the garment and thus the resistance structure or nature could be concealed or made less obvious by being located on the inside of the garment.

Where the garment is made of two pieces the two pieces, i.e. top and pants, can relate in various manners. For example, the top and pants could be separate and distinct without being joined and attached in any manner. Alternatively, the top and bottom or pants could be separate, but could have attaching structure for permanently or preferably detachably securing the sections together. Still further, the top and bottom could be distinct sections of a one piece garment, although not as preferred as the other alternatives.

In order to enhance the resistance or exercise characteristics of the garment it is preferred to anchor remote portions of the elastic bands or material so that a stretching is achieved during bending activities of the user and so that the elastic bands would tend to return to their original condition rather than simply being shifted to another portion of the garment. Various techniques can be used to achieve this anchoring. For example, the garment can have stirrups for the feet and/or hand loops to which the elastic elements would be secured. The pants could have an elastic band or belt around the waist to cooperate with a band or belt at the lower portion of the top. Both waist portions could be detachably secured together. Alternatively the pants could have suspenders in addition to the attachable waistband or by themselves which would go over the shoulders. Various combinations of the above are also possible. Preferably, the pants structures are adjustable at the waist by various mechanisms, such as buckles, buttons, snaps, hook and loop fasteners, etc.

In a preferred form of a two piece suit the loose fitting pants would have suspenders or loops that go over the shoulders and which are adjustable by, for example, a buckle on each side. The suspenders or loops could be padded for shoulder comfort.

The top is preferably a loose fitting jersey that has elastic structure underneath with loops for the hands. The bottom or lower portion of the top could have an elastic band for snug fitting around the waist and over the pants or for attachment to the pants such as by VELCRO, snaps, etc. The waist portion of the pants as well as the waist portion of the top could have a draw string for snug fit.

The concept of providing a garment which includes elastic resistance elements in various forms is shown and described in our U.S. Pat. Nos. 5,109,546, 5,176,600, 5,180,701, 5,201,074, 5,306,222, and 5,570,472 as well as in various pending applications, including Ser. No. 627,426 filed Apr. 4, 1996, Ser. No. 761,290 filed Dec. 6, 1996 and Ser. No. 802,973 filed Feb. 20, 1997. All of the details of the aforenoted patents and applications are incorporated herein by reference thereto.

The various figures illustrate exemplary forms of practicing the invention. In general, the exercise garment would be of multiple layer construction with the outer layer being in the form of a loose fitting material which could be in itself in a conventional warm up suit or sweatsuit. For simplicity purposes the term "sweatsuit" is intended to include "warm up suit". The inner layer could incorporate the elongated resistance elements which would have a shorter overall length than the corresponding lineal length of the outer layer. Thus, during a bending movement by the user there would be a stretching of the inner layer without necessarily causing any stretching of the outer layer. The elongated-resistance elements would be incorporated in at least a portion of the sweatsuit (top and/or pants) having a body portion and a pair of limb portions.

FIG. 1 illustrates an exercise garment in accordance with one embodiment of the invention. As shown therein the garment 10 is a sweatsuit which includes a top section 12 and a pants section 13. Top section 12 may be made in a conventional manner for loose fitting sweatsuits or warmup suits where any suitable known fabrics could be used.

Figure 2:
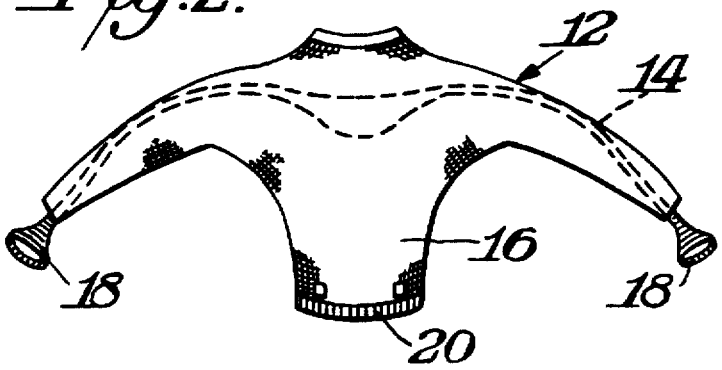
FIG. 2 is a front elevational view of a top portion of a garment in accordance with this invention.

FIG. 2 illustrates the top section 12 and is shown to incorporate a resistance band 14 shown in phantom as being on the inside of the outer layer 16. One such band would be in the front another in the back. It is preferred that remote portions such as at the opposite ends of the resistance band be anchored so as to require a stretching of the band during bending or other body movements. FIG. 2, for example, illustrates each end of band 14 to terminate in a loop member 18 through which the hand would be inserted as shown in FIG. 1. The loop member may be adjustable in its circumference in any suitable manner such as by VELCRO structure. Reference is made to the aforenoted patents and applications for variations of elastic band structure and anchoring techniques.

FIG. 2 also shows a waistband 20 at the lower portion of top 12. Waistband 20 is preferably elastic to fit snugly around the user's waist and could also be adjustable in any suitable manner such as by buckles, buttons, VELCRO, etc.

Waistband 20 may be sufficiently snug to provide a compressive force to the user. If desired other compressive bands could be provided along with the elongated resistance bands, as described in copending application Ser. No. 761,290, filed Dec. 6, 1996, all of the details of which are incorporated herein by reference thereto.

Figure 7:
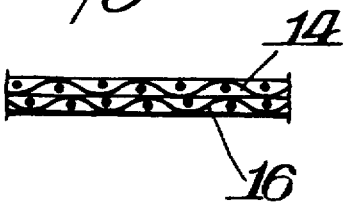
FIG. 7 is a cross-sectional plan view of a modified form of exercise garment in accordance with this invention.

Elastic band 14 may be secured below outer layer 16 in any suitable manner. For example, loops or other guide members may be mounted to the inner surface of outer layer 16 through which the elastic band 14 would pass. If desired, elastic band 14 could be sewn directly to the inner surface of outer layer 16 at suitable spaced locations. It is also possible to simply dispose the elastic band as part of a separate member or inner article of clothing below and connected at suitable spaced-locations to the outer clothing 16. Thus, for example, various aerobic exercise garments of the types disclosed in the aforenoted patents and applications may be worn against the body with the outer clothing in the form of a sweatsuit worn outside of the aerobic elastic resistance clothing. FIG. 7, for example, illustrates how the two such layers 14,16 would simply be juxtaposed each other at location without any physical connection.

FIG. 1 illustrates the pants portion 13 of the garment 10. As shown therein the pants portion 13 would include an outer layer 22 which would comprise by itself the conventional pants in a two piece sweatsuit suit. The plurality of elongated resistance bands 14 is provided as the inner layer of the pants portion. The lower ends of each resistance band may be secured to a loop or stirrup 24 through which the foot would extend so as to be anchored to the lower end. The upper ends of each resistance band 14 would be anchored to the waist 26 of the pants portion 13. The multiple vertical spaced resistance bands 14 could be disposed around and down each leg and could be sewn to the inside of the outer clothing 22 or could be otherwise provided as the inner layer in the manner described with respect to the top 12 with its resistance band 14.

Figure 5:
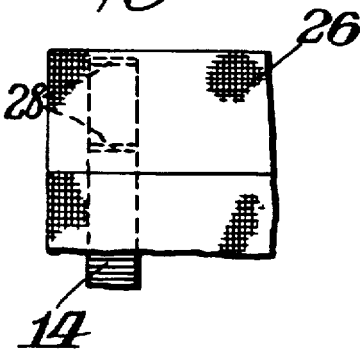
FIGS. 4–5 are front elevational views showing alternative manners of mounting or anchoring the resistance elements to the waist portion of a garment in accordance with this invention.
Figure 4:
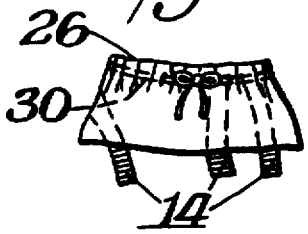

Any suitable manner of attachment may be used for anchoring the upper end of each resistance band to the waist 26 of the pants 13. For example, each resistance band 14 may come up over the top of the pants and then loop over to the outside. FIG. 5, for example, illustrates an elastic resistance band 14 to have its upper end 28 sewn directly to the waistband 26. FIG. 4, illustrates an alternative arrangement wherein the waistband 26 has a draw string 30 and the upper end of each elastic resistance band 14 may be secured to the waistband 26 in any of the aforenoted manners.

Figure 3:
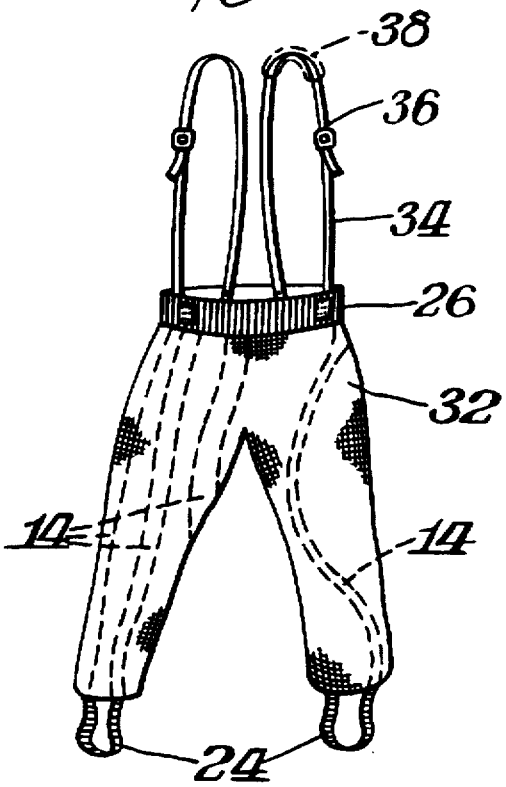
FIG. 3 is a front elevational view of a bottom or pants portion in accordance with this invention.

FIG. 3 illustrates an alternative form of pants 32 which includes suspenders 34 extending upwardly from the waistband 26. FIG. 3 also illustrates that it is not necessary to have each elastic band 14 assume a straight direction from the waist at the upper portion of pants 32 to the bottom of the leg or stirrup 24. Instead, the elastic resistance bands 14 could assume other orientations such as the curved path shown on the right hand portion of FIG. 3. Such curved paths could also be used in the top. A straight path simplifies the combination or anchoring/stretching of the band 14.

In the embodiment shown in FIG. 3 it is preferable to have each suspender 34 adjustable in length by the provision of buckles 36 or other suitable adjusting structure including buttons, velcro, etc. If desired, a shoulder pad 38 could be provided for making the suspenders more comfortable. Suspenders 34 could be elastic resistance bands or could be non-elastic for simply holding up the pants.

Figure 6:
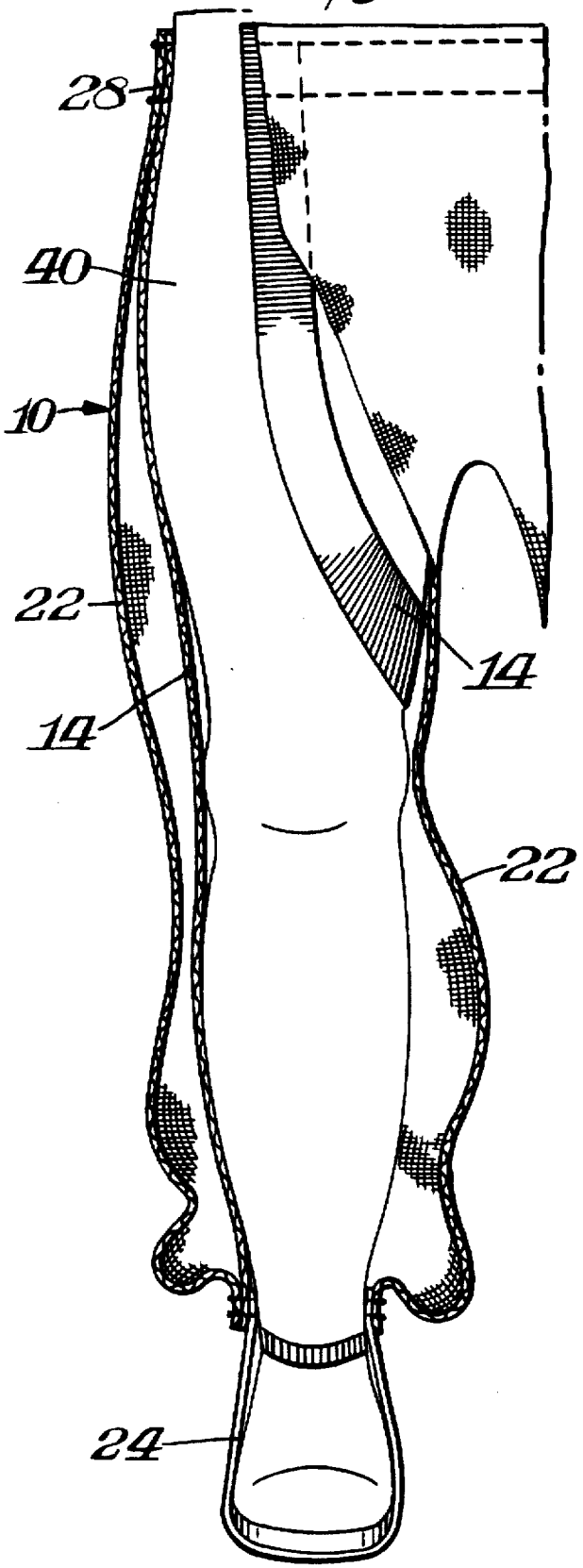
FIG. 6 is a cross-sectional view in elevation of an exercise garment in accordance with this invention.

FIG. 6 illustrates a physical characteristic in the general practice of the invention. FIG. 6 illustrates a portion of the garment 10 as it is worn on the leg 40 of a user. As shown therein, the elastic band 14 is sewn to the outer clothing 22 in the manner illustrated in FIG. 5. Thus, the upper end of elastic band 14 is anchored at the waist of the user. Elastic band 14 is disposed generally in contact with the user's leg and extends downwardly to an anchoring point such as the stirrups 24 as shown in FIGS. 1 and 3. The outer clothing or sweatsuit 22, however, is loose fitting and hangs spaced from the inner layer of elastic material 14. Thus, over a given lineal distance the length of elastic band 14 is less than the length of loose fitting outer clothing 22. It is to be understood, of course, that the loose fitting outer clothing 22 would contact some portions of inner band 14. What is important, however, is that there is a loose fit or extra material for the outer clothing 22 or outer top 16 which permits the outer clothing to function as a sweatsuit and to generally conceal the inner layer which fits more tightly against the body.

As noted, where separate pants and shirt portions are used the two portions could be connected together by complementary connecting structure at the waistbands 20,26. As also noted, although the various figures illustrates the elastic resistance to be achieved by discrete separate elongated resistance bands, the elastic resistance could also be achieved by having elastic panels provided under the outer clothing.

What is claimed is:

1. An exercise garment including an outer suit of clothing comprising at least a part of a sweatsuit having a body portion and a pair of limb portions, said sweatsuit having an inner surface, an inner suit of clothing having an outer surface, said inner suit of clothing being disposed inside of said outer suit of clothing, said inner surface of said sweatsuit and said outer surface of said inner suit being in at least partial contact with each other and being at least substantially free of connection to each other whereby said sweatsuit and said inner suit are free to move independently of each other with said sweatsuit concealing said inner suit, said inner suit of clothing being secured to said outer suit at at least one point said inner suit of clothing being made of a base fabric having elastic resistance elements requiring a greater force to stretch said resistance elements and resist said resistance elements from returning to their unstretched condition than is required for said base fabric, said inner suit of clothing closely fitting against a user whereby the user is required to stretch said elastic resistance elements during body movement of the user and to resist said elastic resistance elements from returning to their unstretched condition, and said sweatsuit being of longer length than the length of said inner suit of clothing over a given lineal distance whereby said sweatsuit is loose fitting on the user and said inner suit is tight fitting.

2. The garment of claim 1 wherein said sweatsuit comprises a top portion and a pants portion, said limb portions being arms of said top portion and legs of said pants portion, and said inner suit being disposed inside of both said top portion and said pants portion.

3. The garment of claim 2 wherein said top portion and said pants portion are detachably secured together.

4. The garment of claim 2 wherein said elastic resistance elements comprise a plurality of spaced elongated elastic resistance bands, said pants portion including a waistband, and said elastic resistance bands being secured to said waistband to anchor said elastic resistance bands to said waistband.

5. The garment of claim 4 wherein said elastic resistance bands include at least one an elastic resistance band extending from the outer portion of one of said arms to the outer portion of the other of said other arms.

6. The garment of claim 5 wherein said elastic resistance band in said top portion is secured to and anchored to hand loops, and said elastic resistance band in said pants portion being secured to and anchored to foot stirrups.

7. The garment of claim 6 wherein a plurality of elastic resistance bands is in each of said top portion and said pants portion.

8. The garment of claim 1 wherein said inner suit is secured to said sweatsuit by being sewn thereto.

9. The garment of claim 1 wherein said sweatsuit comprises a top having arms as said limb portions, and said elastic resistance elements extending from the end of one arm to the end of the other of said arms.

10. The garment of claim 9 wherein said elastic resistance elements include an elongated resistance band connected to and anchored to a hand loop at each of said arm.

11. The garment of claim 1 wherein said outer sweatsuit is a pants portion having a pair of legs as said limb portions, and said elastic resistance elements comprising a plurality of elongated elastic resistance bands extending down said legs and spaced from each other.

12. The garment of claim 11 wherein said pants portion includes a waistband, and said elastic resistance bands being secured to and anchored to said waistband.

13. The garment of claim 12 wherein said elastic resistance bands are connected to and anchored to a foot stirrup at each of said legs.

14. The garment of claim 11 including a set of suspenders mounted to said pants portion.

15. The garment of claim 14 wherein said suspenders is made of elastic resistance bands.

16. The garment of claim 1 wherein said sweatsuit is made of mesh material.

17. A method of performing an exercise including the steps of providing a loose fitting warmup suit, providing an inner exercise suit made of a base fabric and elastic resistance elements wherein the elastic resistance elements require a greater force to stretch the elastic resistance elements and resist the elastic resistance elements returning to their unstretched condition than is required for the base fabric, mounting the inner exercise suit snugly against the user, mounting the warmup suit loosely on the user securing at least one portion of the inner suit to the outer suit to conceal the inner exercise suit, and stretching the elastic resistance elements in response to body movements while the warmup suit continues to be loose fitting with the inner exercise suit moving independently of the warmup suit.

* * * * *